US010074492B2

(12) United States Patent
Felixberger et al.

(10) Patent No.: US 10,074,492 B2
(45) Date of Patent: Sep. 11, 2018

(54) ON-LOAD TAP CHANGER AND METHOD OF EMERGENCY SETTING DEFINED SWITCHING POSITION THEREOF

(71) Applicant: Maschinenfabrik Reinhausen GmbH, Regensburg (DE)

(72) Inventors: Gerhard Felixberger, Regensburg (DE); Johann Jobst, Regenstauf (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 0 days.

(21) Appl. No.: 14/899,568

(22) PCT Filed: Jun. 24, 2014

(86) PCT No.: PCT/EP2014/063257
§ 371 (c)(1),
(2) Date: Dec. 18, 2015

(87) PCT Pub. No.: WO2015/007474
PCT Pub. Date: Jan. 22, 2015

(65) Prior Publication Data

US 2016/0126025 A1 May 5, 2016

(30) Foreign Application Priority Data

Jul. 16, 2013 (DE) ..... 10 2013 107 553

(51) Int. Cl.
*H01H 19/00* (2006.01)
*H01H 21/00* (2006.01)
(Continued)

(52) U.S. Cl.
CPC ..... *H01H 9/0027* (2013.01); *H01H 3/22* (2013.01); *H01H 3/3005* (2013.01); *H01H 3/40* (2013.01);
(Continued)

(58) Field of Classification Search
CPC ..... H01H 19/00; H01H 21/00; H01H 9/0027; H01H 9/0264; H01H 3/22; H01H 3/3005;
(Continued)

(56) References Cited

U.S. PATENT DOCUMENTS 2,727,613 A 12/1955 Radkowski
3,206,999 A 9/1965 Roth
(Continued)

FOREIGN PATENT DOCUMENTS

BG 66062 B1 12/2010
CN 2870107 Y 2/2007
(Continued)

*Primary Examiner* — Anthony R. Jimenez
(74) *Attorney, Agent, or Firm* — Andrew Wilford

(57) ABSTRACT

The invention relates to an electric motor-operated on-load tap changer (1) comprising an emergency drive. An electric motor (3) and a power store (13) of said on-load tap changer (1) are mechanically coupled by means of a gear (5) that is provided with a gear housing (90). The gear (5) comprises a gear shaft (61) on which a toothing (55) is designed. For manual emergency operation, the claimed gear shaft (61) has an extension (62) which comprises a free end (65) for attaching a tool (95). The invention also relates to a method for adjusting a defined switching position of an on-load tap changer (1) when in an emergency operation mode.

8 Claims, 5 Drawing Sheets

(51) Int. Cl.
*H01H 9/00* (2006.01)
*H01H 3/30* (2006.01)
*H01H 3/40* (2006.01)
*H01H 3/22* (2006.01)
*H01H 9/02* (2006.01)

(52) U.S. Cl.
CPC ..... *H01H 9/0264* (2013.01); *H01H 2300/056* (2013.01)

(58) Field of Classification Search
CPC ..... H01H 3/40; H01H 2300/056; H01H 2009/20; H01H 2009/0005; H01H 2009/0016; H01H 2009/0044; H01H 2009/0022; H01H 9/0016; H01H 9/0005; H01H 9/0011; H01H 9/0033; H01H 9/0038; H01H 9/0044; H01H 9/0061
USPC ..... 200/11 TC
See application file for complete search history.

(56) References Cited

U.S. PATENT DOCUMENTS 3,780,625 A * 12/1973 Weston ..... F15B 15/06 200/48 R
5,222,457 A 6/1993 Friedrich
5,834,717 A * 11/1998 Neumeyer ..... H01H 25/06 200/11 TC
8,119,939 B2 * 2/2012 Albrecht ..... H01H 9/0027 200/11 TC
8,242,399 B2 * 8/2012 van Dijk ..... H01H 33/42 200/251
2004/0011631 A1 1/2004 Baertl
2008/0169178 A1 7/2008 Baertl et al.
2008/0231003 A1 * 9/2008 Moriyama ..... B60R 13/0846 277/636
2012/0241300 A1 9/2012 Brasher et al.
2014/0096632 A1 4/2014 Mathae

FOREIGN PATENT DOCUMENTS

CN 202258744 U 4/2011
CN 102623210 A 4/2012
CN 102623210 A 8/2012
CN 102623208 B 11/2015
DE 3541888 A 6/1987
DE 3541888 A1 6/1987
DE 19731706 C2 2/1999
DE 69321251 T2 10/2000
DE 10055406 A 4/2002

* cited by examiner

ON-LOAD TAP CHANGER AND METHOD OF EMERGENCY SETTING DEFINED SWITCHING POSITION THEREOF

CROSS REFERENCE TO RELATED APPLICATIONS

This application is the US-national stage of PCT application PCT/EP2014/063257 filed 24 Jun. 2014 and claiming the priority of German patent application 102013107553.3 itself filed 16 Jul. 2013.

FIELD OF THE INVENTION

The present invention relates to an on-load tap changer. In particular, the on-load tap changer has an electric motor and a force-storing unit that are mechanically coupled by a transmission provided with a transmission housing. The transmission comprises a transmission shaft on which teeth are formed.

In addition, the invention relates to a method of emergency-operation setting a defined switching position of an on-load tap changer.

BACKGROUND OF THE INVENTION

On-load tap changers (in abbreviation OLTC) are widely known and customary in the prior art. They serve for uninterrupted switching-over between different winding taps of tapped transformers. On-load tap changers are divided into load selectors and load changeover switches with selectors.

In the case of a load changeover switch with a selector such as disclosed in, for example, German Patent Specification DE 100 55 406 C1 the selector, consisting of a fine selector and possibly a preselector, is below the load changeover switch. The selector serves for power-free selection of the respective new winding tap of the tapped transformer that is to be switched over to. The load changeover switch serves for the subsequent rapid and uninterrupted switching over from the connected winding tap to the new, preselected winding tap to be connected.

Chinese Utility Model specification CN 2870107 Y discloses a control drive for an on-load tap changer comprising a transmission with a horizontal drive shaft. One end of the drive shaft can be coupled with a drive motor. The rest of the transmission is surrounded by a transmission housing. The horizontal drive shaft transmits its rotational movement to the drive input shaft by an angle gear consisting of a bevel pinion of the drive shaft and of a bevel gear of the drive input shaft.

Chinese Patent Application CN 102623210 A discloses a motor-driven transmission with a planetary gear and a setting indicator for an on-load tap changer.

Chinese Utility Model specification CN 202258744 U relates to a transmission and a transmission control for on-load tap changers, particularly with an electrical system for emergency operation. A vertically mounted drive output shaft and a drive shaft are provided in a transmission housing. The drive shaft is provided with a cross member and an axial bearing. In addition, a worm wheel on the drive output shaft is connected with the drive shaft by a worm shaft. The electrical system and the transmission control allow switching over between electrical and manual operation of the on-load tap changer.

Bulgarian Patent Specification BG 66062 B1 discloses a transmission for electric-motor actuation of an on-load tap changer. The connection of the shaft of the electric motor and the drive shaft of the on-load tap changer is realized by a planetary gear integrated in the flange of the electric motor. A control shaft is mechanically coupled with the drive shaft by a worm gear. One end of the control shaft is led out of the transmission housing and carries a disk with one or more cut-outs co-operating with a controller.

German published specification DE 35 41 888 A1 discloses a transmission for stepped actuation of a tap changer for tapped transformers with a manual drive shaft actuatable by a hand crank. A drive output shaft can be coupled with a tap changer shaft and executes one revolution per switching step. A housing comprises a speed-change transmission that couples the manual drive shaft and drive output shaft, and a switch setting indicator with a viewing window. Manual drive shaft and drive output shaft are in parallel and are mechanically coupled by an orthogonal transmission shaft via a respective worm thread. Through different gradients of these two threads the transmission can translate one revolution of the drive shaft into eight-and-a-half revolutions at the hand crankshaft, which a user has to produce in manual operation.

OBJECT OF THE INVENTION

It is an object of the invention to create a simply constructed, economic and low-maintenance on-load tap changer at which in manual emergency drive a defined switching position can be set in a manner that is reliable, free of damage, ergonomic and simple to produce.

A further object of the invention is to create a method by which in manual emergency drive a defined switching position of an on-load tap changer is settable in a manner that is reliable, free of damage, ergonomic and simple to produce.

SUMMARY OF THE INVENTION

The on-load tap changer according to the invention comprises a drive, preferably an electric motor, for drawing up a force-storing unit that effects the actual switching of the on-load tap changer. Electric motor and force-storing unit are mechanically coupled by a transmission. The transmission is provided with a transmission housing and has a transmission shaft on which teeth such as, for example, a helical thread are formed. An extension having a free end for attachment of a tool is formed at the transmission shaft. In particular, the free end can be formed as an adapter for mechanically positive attachment of a tool. The adapter can be, for example, an internal hexagon head that can be operated by a corresponding tool. Adapter and tool co-operate in accordance with the key/lock principle so that the transmission shaft can be correspondingly operated.

In one form of embodiment of the on-load tap changer according to the invention the free end of the extension of the transmission shaft can project from an opening in the transmission housing in order to attach the tool to the free end. In an alternative form of embodiment the free end of the extension of the transmission shaft can be accessible by the opening of the transmission housing. In this case, the tool projects into the transmission housing in order to actuate the transmission shaft for emergency operation.

The opening in the transmission housing can be provided with a protective cap detachable from the transmission housing and that covers, in particular mechanically positively, the free end of the extension of the transmission shaft and also the opening of the transmission housing. The protective cap is preferably provided with a sealing element so as to prevent ingress of dirt or moisture into the transmission.

In particular, the protective cap can be so designed and arranged that, mounted on the transmission housing, it actuates a safety cutoff switch in the transmission housing. The safety cutoff switch can, for example, free a current circuit of the electric motor as soon as it is actuated. Consequently, the current circuit of the electric motor is interrupted for safety reasons when the protective cap is pulled off. It is ensured for a user of the tool attached to the free end of the transmission shaft that the transmission is not damaged by erroneous activation of the electric motor or the user himself or herself injured. A projection is formed at the protective cap for interruption of the current circuit of the electric motor. When the protective cap is mounted on the transmission housing the projection projects through the opening into the transmission housing and actuates the safety cutoff switch so that the current circuit of the electric motor is closed.

In a special form of embodiment the electric motor can be mechanically coupled with the transmission shaft by first rotary-speed changing means and the transmission shaft can be mechanically coupled with a drive input shaft of the force-storing unit by second rotary-speed changing means. Rotary-speed changing means in the context of the invention is, for example, a preferably slip-free, non-switching transmission with a rotational speed ratio different from 1:1 between input rotational speed and output rotational speed. The first rotary-speed changing means can be formed by a pinion and a gear mechanically coupled therewith. In that case the pinion is fixed to the electric motor and the gear with the transmission shaft. The second rotary-speed changing means can be formed by the teeth formed as a worm thread of the transmission and a helical gear mechanically coupled therewith. The helical gear is fixed to the drive input shaft.

The invention additionally relates to a method of emergency-operation setting a defined switching position of an on-load tap changer. In a first method step a protective cap mounted on a transmission housing is removed. In the mounted state, the protective cap covers a free end of an extension of a transmission shaft of a transmission. The transmission mechanically couples an electric motor with a force-storing unit for actuation of a preselector and/or a switching column of the on-load tap changer. In a subsequent method step a tool is attached to the free end of the extension of the transmission shaft. In the method step following thereon the transmission shaft is rotated by turning the tool by a user until the force-storing unit is completely loaded. As soon as the force-storing unit is fully loaded, it is freed by a mechanical device and its relaxation movement is converted into a defined rotational movement of a switching column and/or for actuation of a preselector of the on-load tap changer.

An advantage of the invention is the simple, reliable, robust and economic mode of construction of a transmission for an on-load tap changer. For manual emergency drive of the on-load tap changer or in order to achieve a defined switch setting the on-load tap changer the transmission shaft has the extension, the free end of which can be used as an attachment point for manual emergency drive of the on-load tap changer.

In particular, it is advantageous that in the on-load tap changer according to the invention the electric motor in emergency operation does not have to be demounted, but merely a protective cap has to be taken off. In emergency operation the user and the on-load tap changer are additionally protected in that the protective cap triggers, only in the state of being mounted on the transmission housing, a safety cutoff switch that releases the current circuit of the electric motor. In emergency operation the electric motor is switched to be without current.

Depending on the respective design of the first and second rotary-speed changing means, the number of revolutions that the electric motor or a user—by the tool attached to the free end of the extension of the drive shaft—has to execute in order to draw up the force-storing unit can be set independently of one another. This has the advantage that the manual emergency operation by the tool and at the same time the electric-motor operation can be designed for respective ergonomic values of revolutions per stressing process of the force-storing unit or of torques. For example, the force-storing unit can be fully loaded by one revolution of the drive input shaft with a torque of, typically, 150 Nm. Through a suitably selected translation ratio of the second rotary-speed changing means a user has to exert, for example, only 10 Nm torque in order to fully draw up the force-storing unit by 25.5 revolutions. At the same time, through a suitably selected translation ratio of the first rotary-speed changing means of the electric motor it is possible to operate in very much higher and more power-efficient rotational speed and torque ranges, for example with 128 revolutions per switching or a torque of only 2.3 Nm.

BRIEF DESCRIPTION OF THE DRAWING

The invention and the advantages thereof are described in more detail in the following with reference to the accompany drawings, in which.

SPECIFIC DESCRIPTION OF THE INVENTION

Figure 1:
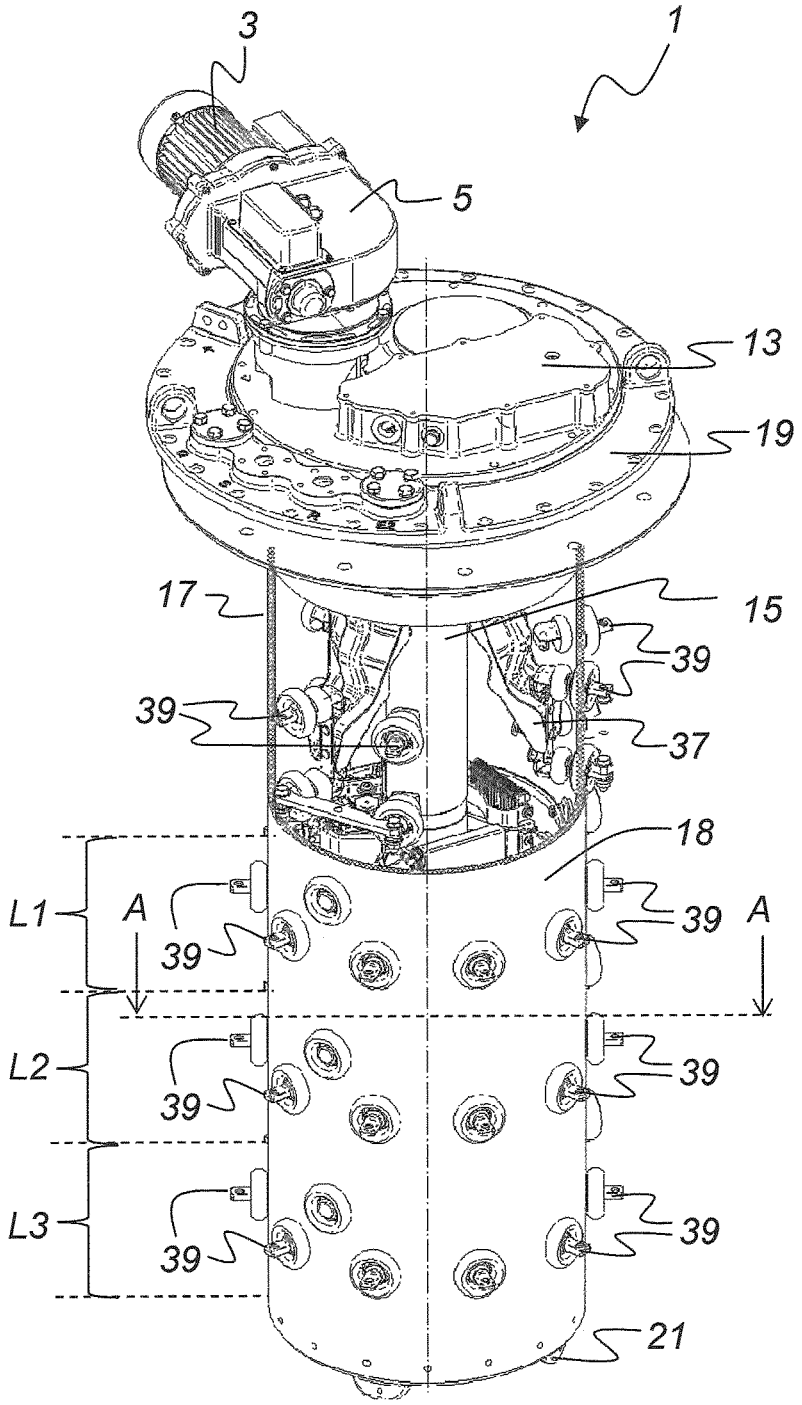
FIG. 1 shows a perspective view of an on-load tap changer according to the invention in the form of a three-phase load selector.

Identical reference numerals are used for the same or equivalent elements of the invention. For the sake of clarity, only reference numerals are illustrated that are required for description of the respective figure. The forms of embodiment that are illustrated by example, of the on-load tap changer according to the invention and the transmission according to the invention for a force-storing unit of an on-load tap changer do not represent a restriction of the scope of protection defined by the patent claims, for the invention.

FIG. 1 shows a perspective view of an on-load tap changer according to the invention in the form of a three-phase load selector 1. The load selector 1 comprises an electric motor 3 with a transmission 5 that loads a force-storing unit 13. When the force-storing unit 13 is fully loaded, i.e. stressed, it is unlatched, abruptly releases its energy and actuates a switching tube 15. The rotating switching tube 15 is in that case rotatably mounted in the oil tank 18. The oil tank 18 is enclosed upwardly by a cover 19 and additionally carries a base element 21.

The load selector 1 according to the invention has three phases L1, L2, L3 that are one above the other in the oil tank 18. A preselector 37 is seated above the three phases L1, L2, L3. Electrical terminal elements 39 for diverter contacts or step contacts of the preselector 37 and the three phases L1, L2, L3 are in that case so arranged at the load selector 1 that they pass through a wall 17 of the oil tank 18.

Figure 2:
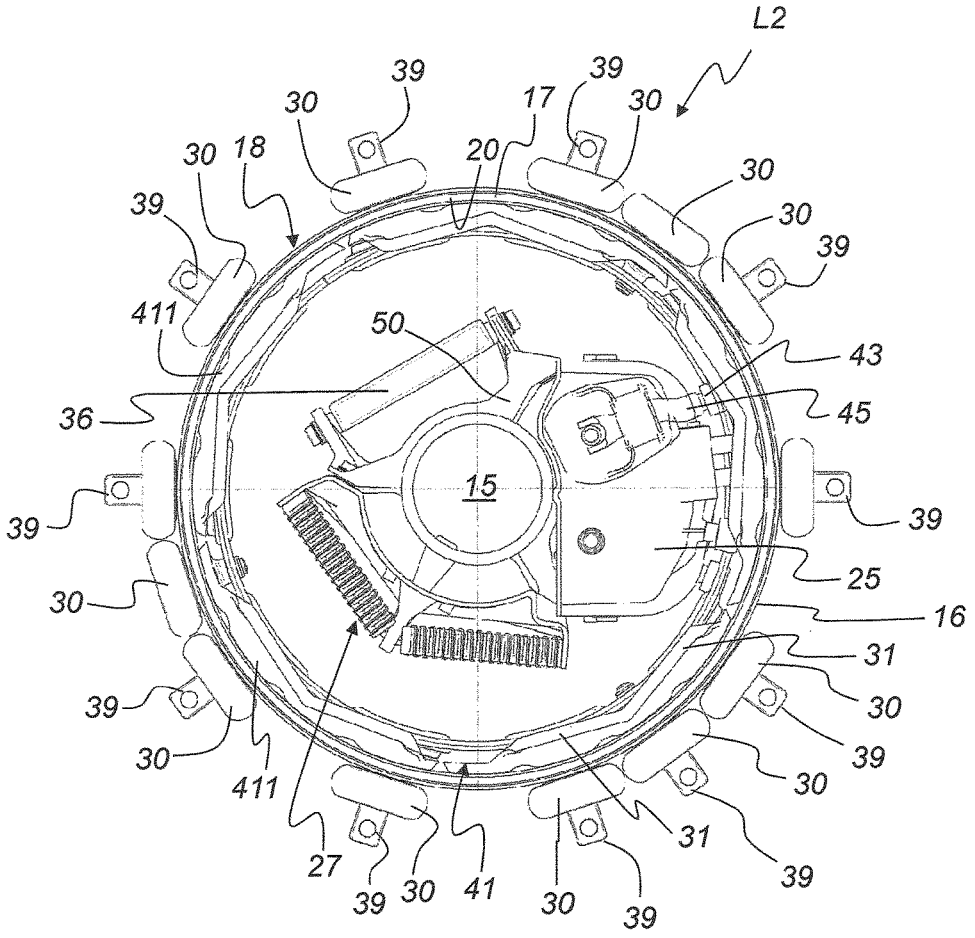
FIG. 2 shows a sectional view of the load selector along the section line A-A illustrated in FIG. 1.

FIG. 2 shows a sectional view along the line A-A of the load selector 1 of FIG. 1, in which a plan view of the phase L2 is illustrated. Several plate-shaped elements 411 that are adapted to the contour of an inner wall 20 of the oil tank 18 and represent an actuating element 41, are at the inner wall 20 of the oil tank 18 for the phase L2. Electrical terminal elements 39 for the diverter contacts or step contacts pass through the corresponding plate-shaped elements 411 and through the oil tank 18 at the outer wall 16 thereof. Protective caps 30 at the outer wall 16 of the oil tank 18 hold the plate-shaped elements 411 at the inner wall 20 of the oil tank 18. For that purpose, the electrical terminal elements 39 co-operate by protective caps 30 with the diverter contacts (not illustrated) or the step contacts (not illustrated), so that the plate-shaped elements 411 are mounted at the inner wall 20 of the oil tank 18. The protective caps 30 rest on the outer wall 16 of the oil tank 18. Each of the plate-shaped elements 411 is formed with at least two control cams 31 that co-operate with corresponding actuating levers 45 that are provided with rollers 43, of the switching segment 25 of the corresponding phase L1, L2, L3.

The switching tube 15 carries, in each phase L1, L2, L3, a mount 50 on which the high-mass element 36, the resistance arrangement 27 and the switching segment 25 are mounted. The switching segment 25 is in that case mounted in such a way that the rollers 43 of the actuating levers 45 co-operate with the corresponding control cams 31 of the plate-shaped elements 411.

Figure 3:
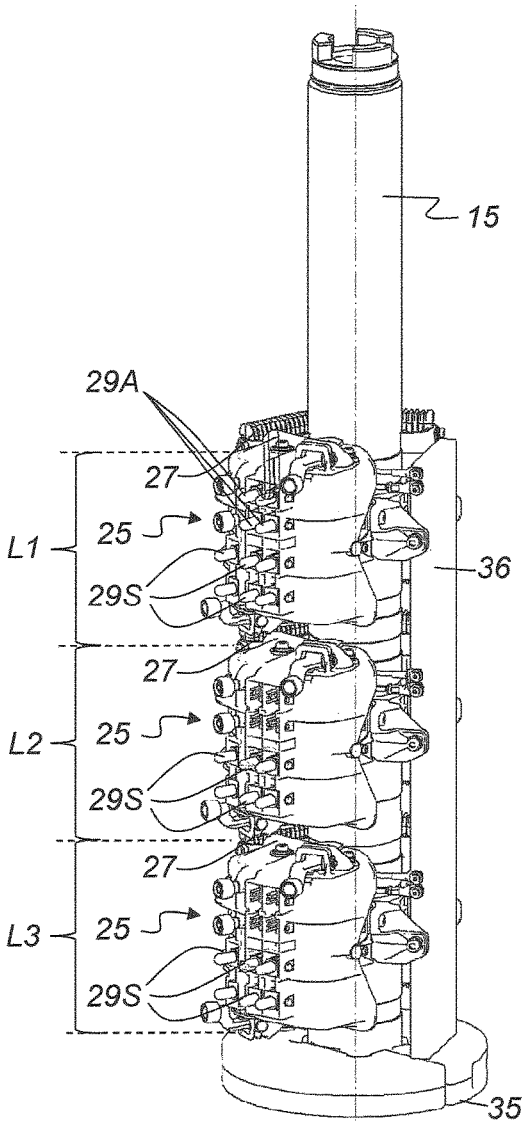
FIG. 3 shows a perspective view of the switching tube of the three-phase load selector according to FIG. 1, in which three switching segments fastened to the switching tube and the high-mass element can be seen.
Figure 4:
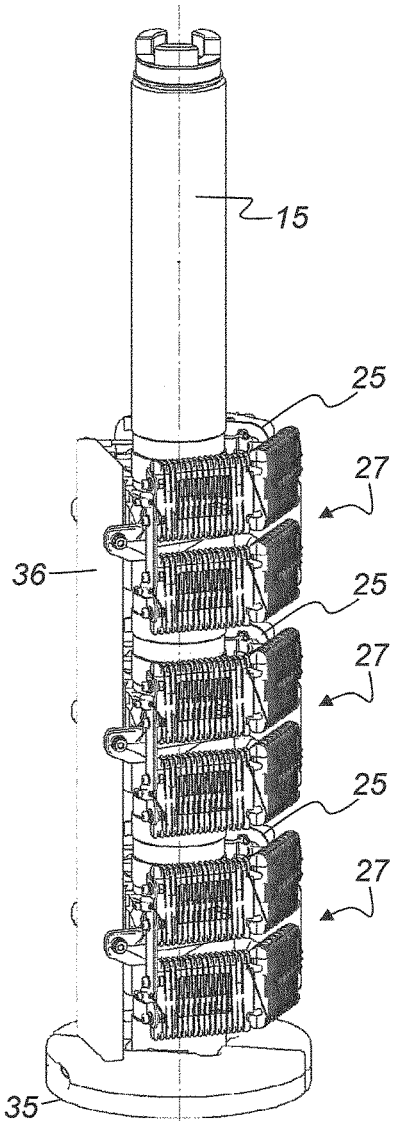
FIG. 4 shows a further perspective view of the switching tube of the three-phase load selector according to FIG. 1, in which three resistance arrangements fastened to the switching tube and the high mass element can be seen.

FIGS. 3 and 4 show different perspective views of the switching tube 15 of the three-phase load selector 1 according to FIG. 1, with three switching segments 25 fastened to the switching tube 15, so that the load selector 1 (see FIG. 2) comprises the three phases L1, L2, L3. Apart from the switching segments 25, also fastened to the rotating switching tube 15 are resistance arrangements 27 associated with the individual phases L1, L2, L3 of the load selector 1. Through rotation of the switching tube 15, contacts for step contacts 29S and contacts for diverter contacts 29A can be directly connected, wherein the contacts for step contacts 29S and the contacts for diverter contacts 29A co-operate with corresponding diverter contacts (not illustrated here) and step contacts (similarly not illustrated), respectively. A predetermined switching sequence is realized by means of the control cams 31 (see, with respect thereto, FIG. 2) so that several vacuum interrupters (not illustrated) in the individual switching segments 25 are opened or closed.

According to the invention the switching tube carries a flywheel mass 35, wherein in addition a high-mass element 36 is mounted on the switching tube. The high-mass element 36 can similarly be seated on the flywheel mass. The high-mass element 36 and the flywheel mass 35 serve to assist the rotational movement of the switching tube 15 so as to ensure a defined switching from one switching position to the next.

Figures 5, 5A:
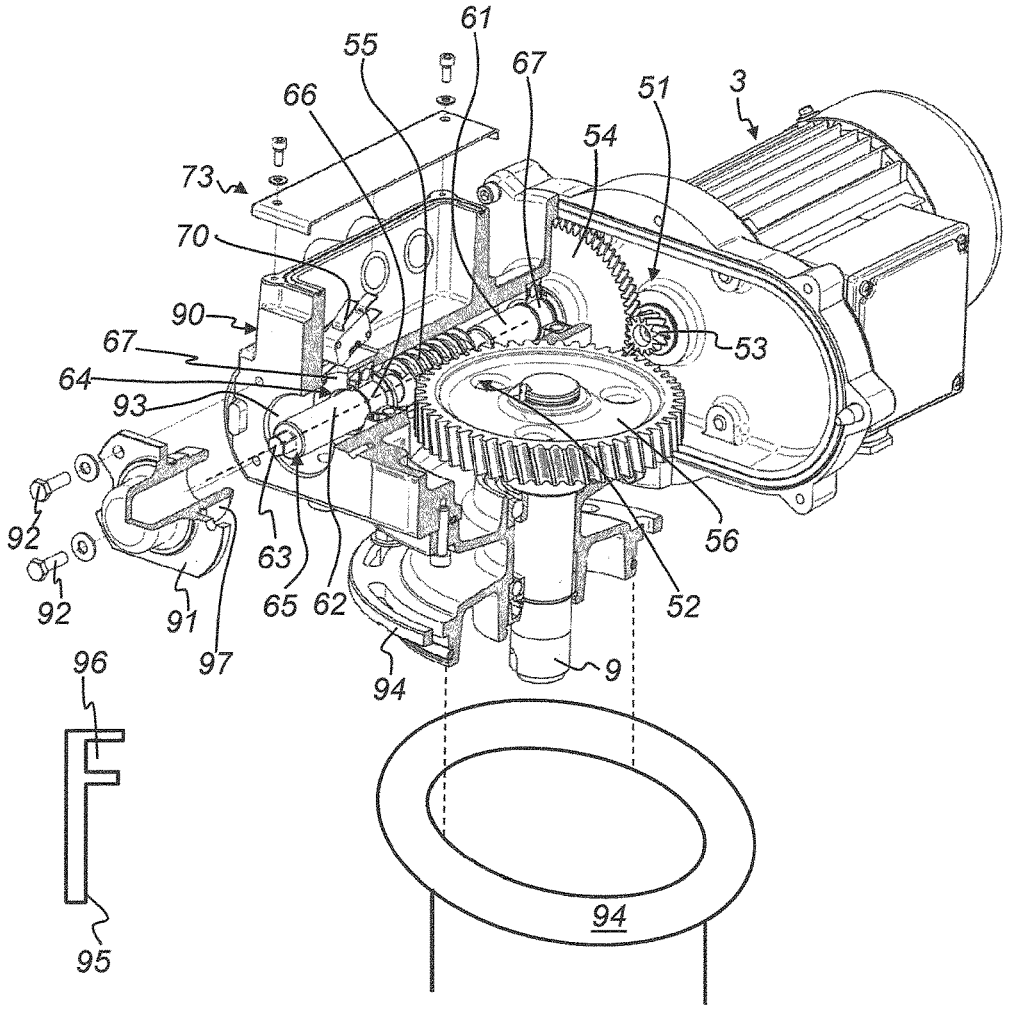
FIG. 5 shows a perspective of the transmission according to the invention.
FIG. 5A is a view of a tool usable with the instant invention.

FIG. 5 shows a perspective view of the transmission 5 according to the invention, in which parts of a transmission housing 90 have been removed so as to afford a better view of the construction of the transmission 5. An electric motor 3 is detachable from the transmission housing 90. A motor shaft (not illustrated) of the electric motor 3 is connected with a pinion 53 of the transmission 5. The pinion 53 engages in a gear 54 fixed to a transmission shaft 61. The pinion 53 and the gear 54 form first rotary-speed changing means 51 that transmits the rotational movement of the motor shaft to the transmission shaft 61, with a first translation ratio. The transmission shaft 61 is mounted in the transmission housing between two bearings 67. The transmission shaft 61 carries, between the two bearings 67, teeth 55 formed as a worm thread. This worm thread engages in a helical gear 56 fixed to a drive input shaft 9 for drawing up a force-storing unit 13. The worm thread and the helical gear 56 together form second rotary-speed changing means 52 that transmits the rotational movement of the transmission shaft 61 to the drive input shaft 9, with a second translation ratio. Since the first rotary-speed changing means 51 and the second rotary-speed changing means 52 are serially arranged, the effective translation ratio of the motor shaft with respect to the drive input shaft 9 arises through multiplication of the first and second translation ratios.

An extension 62 with a free end 65 is formed on the transmission shaft 61 at the end remote from the electric motor 3. In the present embodiment, the free end 65 carries an adapter 63 formed as a hexagon head, screw head, ring, etc., and to which a proprietary tool 95 (FIG. 5A) can be attached. The extension 62 of the transmission shaft 61 projects through an opening so that it is not in contact with the transmission housing 90 and its free end 65 lies outside the transmission housing 90. This facilitates attachment of the tool 95 and turning the tool 95.

The protective cap 91 covers the opening 93 of the transmission housing 90 and the free end 65 of the extension 62 of the transmission 61 when it is mounted on the transmission housing by three fastening means 92. In that case, a projection 97 formed at the protective cap 91, projects through the opening 93 into the transmission housing 90. The projection 97 can be tubular. In the mounted state of the protective cap 91 the projection 97 actuates a safety cutoff switch 70 in a closed safety cutoff switch chamber 73 of the transmission housing 90. The transmission housing 90 can be mounted by a flange 94 on a cover 19 of the on-load tap changer 1 or on an intermediate housing 94.

Figure 6:
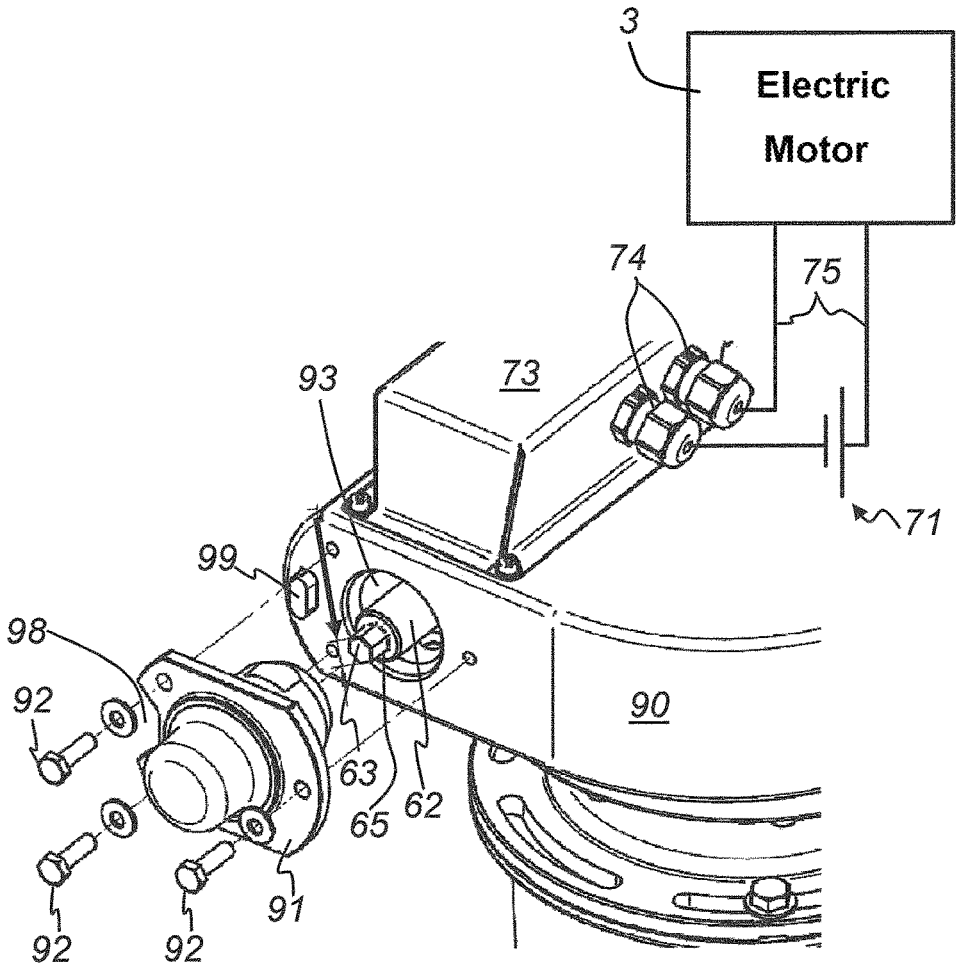
FIG. 6 shows a perspective part view of the transmission housing according to FIG. 5 with an opening in the transmission housing and a protective cap for closure thereof.

FIG. 6 shows a perspective part view of the transmission housing 90 according to FIG. 5 with the opening 93 formed in the transmission housing 90, and the protective cap 91 for closure thereof. A mounting aid 99, with which a cut-out 98 formed at one side at the protective cap corresponds, is formed at the transmission housing 90. Through this arrangement, the orientation in which the protective cap 91 can be mounted on the transmission housing 90 is uniquely fixed. Two terminals 74 by which the safety cutoff switch 70 is connected with the electrical lines of the current circuit 71 of the electric motor 3 are formed in the safety cutoff switch chamber 73 closed toward the outside, of the transmission housing 90. The safety cutoff switch 70 interrupts the current circuit 71 as soon as the projection 97 of the protective cap 91 no longer acts thereon.

The invention claimed is:

1. In combination with an on-load tap changer:

an electric motor outside the on-load tap changer;

a force-storing unit on the on-load tap changer;

a transmission on the on-load tap changer, connecting the force-storing unit to the electric motor, and having a transmission housing and a transmission shaft formed with teeth and having one end connected to the motor and an opposite free end accessible from outside of the tap changer and attachable to a separate tool for loading of the force-storing unit by the separate tool; and a protective cap over the free end of the shaft and detachable from the transmission housing.

2. The combination defined in claim 1, wherein the free end of the shaft projects from an opening of the transmission housing or is accessible through the opening of the transmission housing.

3. In combination with an on-load tap changer having a switching tube:

an electric motor outside the on-load tap changer;

a force-storing unit on the on-load tap changer and connected to the switching tube;

a transmission on the on-load tap changer, connecting the force-storing unit to the electric motor, and having a transmission housing and a transmission shaft formed with teeth;

a shaft having a free end accessible from outside of the tap changer for attachment of a separate tool and an opposite end connected to the motor;

a protective cap over the free end of the shaft and detachable from the transmission housing; and a safety cutoff switch in the transmission housing and actuatable by the protective cap mounted on the transmission housing.

4. The combination defined in claim 3, wherein a projection is formed on the protective cap and, when the protective cap is mounted on the transmission housing, so projects into the transmission housing as to actuate and hold closed the safety cutoff switch.

5. The combination defined in claim 3, wherein the electric motor is mechanically coupled with the transmission shaft by first rotary-speed changing means and the transmission shaft is mechanically coupled with a drive input shaft of the force-storing unit by a second rotary-speed changing means.

6. The combination defined in claim 5, wherein the first rotary-speed changing means is formed by a pinion and a gear mechanically coupled therewith, the pinion being fixed to the electric motor and the gear to the transmission shaft.

7. The combination defined in claim 5, wherein the second rotary-speed changing means is formed by the teeth that are formed as a worm thread of the transmission and a helical gear mechanically coupled therewith, the helical gear being fixed to the drive input shaft.

8. A method of emergency-operation setting a defined switching position of an on-load tap changer having a switching tube and in combination with:

an electric motor outside the on-load tap changer;

a force-storing unit on the on-load tap changer and connected to the switching tube;

a transmission also outside of the on-load tap changer, connecting the force-storing unit to the electric motor, and having a transmission housing and a transmission shaft formed with teeth;

a shaft having one end connected to the electric motor and an opposite free end accessible from outside of the tap changer and attachable with the tool for attachment of the tool; and a protective cap over the free end of the shaft and detachable from the transmission housing;

the method comprising the following steps:

removing the protective cap mounted on the transmission housing of the transmission for the force-storing unit such that the free end of the shaft is accessible;

attaching a separate tool to the free end of the shaft; and turning the tool until the force-storing unit is fully loaded.

* * * * *